US008373501B2

(12) United States Patent
Suzuki

(10) Patent No.: US 8,373,501 B2
(45) Date of Patent: Feb. 12, 2013

(54) REFERENCE VOLTAGE CIRCUIT

(75) Inventor: Teruo Suzuki, Chiba (JP)

(73) Assignee: Seiko Instruments Inc., Chiba (JP)

( * ) Notice: Subject to any disclaimer, the term of this patent is extended or adjusted under 35 U.S.C. 154(b) by 168 days.

(21) Appl. No.: 13/049,072

(22) Filed: Mar. 16, 2011

(65) Prior Publication Data

US 2011/0234298 A1 Sep. 29, 2011

(30) Foreign Application Priority Data

Mar. 23, 2010 (JP) ..... 2010-067067
Oct. 29, 2010 (JP) ..... 2010-244376

(51) Int. Cl.
*G05F 1/10* (2006.01)
*G05F 3/02* (2006.01)

(52) U.S. Cl. ..... 327/541

(58) Field of Classification Search ..... 327/530, 327/538, 540, 541, 543
See application file for complete search history.

(56) References Cited

U.S. PATENT DOCUMENTS 5,514,948 A * 5/1996 Okazaki ..... 323/314
6,194,955 B1 * 2/2001 Ishida ..... 327/538
6,198,337 B1 * 3/2001 Matsuura ..... 327/525
6,348,833 B1 2/2002 Tsujimoto et al.
6,798,278 B2 * 9/2004 Ueda ..... 327/541

FOREIGN PATENT DOCUMENTS

JP 2000-056843 A 2/2000

* cited by examiner

*Primary Examiner* — Quan Tra
(74) *Attorney, Agent, or Firm* — Brinks Hofer Gilson & Lione

(57) ABSTRACT

Provided is a reference voltage circuit having a soft start function, which is small in circuit size and is capable of providing a continuous voltage. The reference voltage circuit includes a reference voltage section and a soft start circuit. The reference voltage section includes a depletion mode MOS transistor and a first enhancement mode MOS transistor. The soft start circuit includes: a second enhancement mode MOS transistor having a gate connected to a gate and a drain of the first enhancement mode MOS transistor, and a drain connected to an output terminal of the reference voltage circuit; a MOS switch having one terminal connected to an output terminal of the reference voltage section, and another terminal connected to the drain of the second enhancement mode MOS transistor; and a constant current source and a capacitor connected in series between a power supply and a ground.

6 Claims, 3 Drawing Sheets

REFERENCE VOLTAGE CIRCUIT

RELATED APPLICATIONS

This application claims priority under 35 U.S.C. §119 to Japanese Patent Application Nos. 2010-067067 filed on Mar. 23, 2010 and 2010-244376 filed on Oct. 29, 2010, the entire contents of which are hereby incorporated by reference.

BACKGROUND OF THE INVENTION

1. Field of the Invention

The present invention relates to a reference voltage circuit, and more particularly, to a reference voltage circuit having a soft start function in which a reference voltage gradually rises after an elapse of a predetermined time period.

2. Description of the Related Art

Generally, in a reference voltage circuit having a soft start function, a charge period of charging a capacitor by a constant current source is set as a soft start time period. After a charged voltage exceeds a predetermined voltage, a switch is switched, to thereby transit from the soft start voltage to a predetermined reference voltage (for example, see Japanese Patent Application Laid-open No. 2000-56843).

A conventional reference voltage circuit is described. FIG. 2 is a circuit diagram of the conventional reference voltage circuit. The reference voltage circuit includes a constant voltage source 101 and a soft start circuit. The soft start circuit includes a comparator 103, a delay circuit 104, a constant current source 102, a capacitor C, a resistor R, and switches SW1 to SW3.

A connection point between the constant current source 102 and the capacitor C is connected to an output terminal Vref of the reference voltage circuit. The comparator 103 has a non-inverting input terminal connected to the output terminal Vref, and an inverting input terminal connected to an output terminal of the constant voltage source 101 via an offset voltage Vos. Further, the comparator 103 has an output terminal connected to the switch SW2, the constant current source 102, and the delay circuit 104. The delay circuit 104 has an output terminal connected to the switch SW3.

The capacitor C receives a constant current Ic from the constant current source 102 to be charged. The comparator 103 compares a voltage obtained by subtracting the predetermined offset voltage Vos from an output voltage Vbgr of the constant voltage source 101 with a voltage at the connection point between the constant current source 102 and the capacitor C. Then, the comparator 103 outputs an output voltage reflecting the comparison result. When the voltage at the connection point between the constant current source 102 and the capacitor C is higher than the voltage obtained by subtracting the predetermined offset voltage Vos from the output voltage Vbgr of the constant voltage source 101, the switch SW2 is turned ON, the constant current source 102 stops supplying current, and the delay circuit 104 starts its operation. When the switch SW2 is turned ON, the capacitor C is charged by the constant voltage source 101 via the resistor R with an RC time constant. The output of the delay circuit 104 is connected to the switch SW3, and causes the switch SW3 to turn ON after an elapse of a predetermined time period from the operation start of the delay circuit 104. When the switch SW3 is turned ON, the output voltage Vbgr of the constant voltage source 101 is directly connected to the reference voltage Vref.

An operation of the conventional reference voltage circuit is described.

Under a state in which the switch SW1 is ON, the operation of the reference voltage circuit is stopped, and the reference voltage of the output terminal Vref is 0 V.

When the switch SW1 is turned OFF, the reference voltage circuit starts its operation. The capacitor C receives the constant current Ic from the constant current source 102 to start constant current charging. At this time, the reference voltage Vref increases linearly depending on the constant current Ic and the capacity of the capacitor C. When the voltage charged in the capacitor C exceeds Vbgr-Vos, the output signal of the comparator 103 is inverted. Thus, the switch SW2 is turned ON, the constant current source 102 stops supplying current, and the delay circuit 104 starts its operation. Because the constant current source 102 stops supplying current, the capacitor C is charged with power supplied from the output voltage Vbgr of the constant voltage source 101 via the resistor R.

After an elapse of a predetermined time period from the operation start of the delay circuit 104, the switch SW3 is turned ON, and thus the output voltage Vbgr of the constant voltage source 101 is directly provided as the reference voltage Vref.

In the conventional reference voltage circuit, switches are switched to set a soft start period and a predetermined reference voltage Vref. In this case, in order to generate switching signals for the switches, it is necessary to provide a comparator for comparing the internal reference voltage with the soft start voltage, and a delay circuit. As a result, the circuit size increases.

Further, there is a problem in that there appears discontinuity in the linearly increasing reference voltage because switching between the soft start period and the reference voltage output period is performed by the switches.

SUMMARY OF THE INVENTION

The present invention has been made in view of the above-mentioned problems, and therefore provides a reference voltage circuit having a soft start function, which is capable of providing a reference voltage without discontinuity.

In order to solve the above-mentioned problems, the reference voltage circuit according to the present invention has a configuration as follows.

A reference voltage circuit includes: a reference voltage section including a depletion mode MOS transistor and a first enhancement mode MOS transistor; and a soft start circuit, in which the soft start circuit includes: a second enhancement mode MOS transistor having a gate connected to a gate and a drain of the first enhancement mode MOS transistor, and a drain connected to an output terminal of the reference voltage circuit; a MOS switch having one terminal connected to an output terminal of the reference voltage section, and another terminal connected to the drain of the second enhancement mode MOS transistor; and a constant current source and a capacitor connected in series between a power supply and a ground, and in which the MOS switch is gradually turned ON by a voltage supplied when the capacitor is charged with a current of the constant current source, to thereby gradually raise a reference voltage.

According to the reference voltage circuit of the present invention as described above, a comparator or a delay circuit for generating a switch signal of a switch SW is unnecessary, and hence the circuit size may be reduced. With the reduction in chip size, there is an effect that the manufacture cost can be reduced to form an inexpensive product.

Further, the reference voltage can be output continuously between the soft start operation and the stable operation.

Still further, even in a case where the output terminal of the reference voltage circuit is connected only to the gate of the MOS transistor, a stable soft start operation can be performed because an initial value of the reference voltage in the soft start operation is 0 V.

DETAILED DESCRIPTION OF THE PREFERRED EMBODIMENTS

Hereinafter, a reference voltage circuit according to the present invention is described with reference to the drawings.

(First Embodiment)

Figure 1:
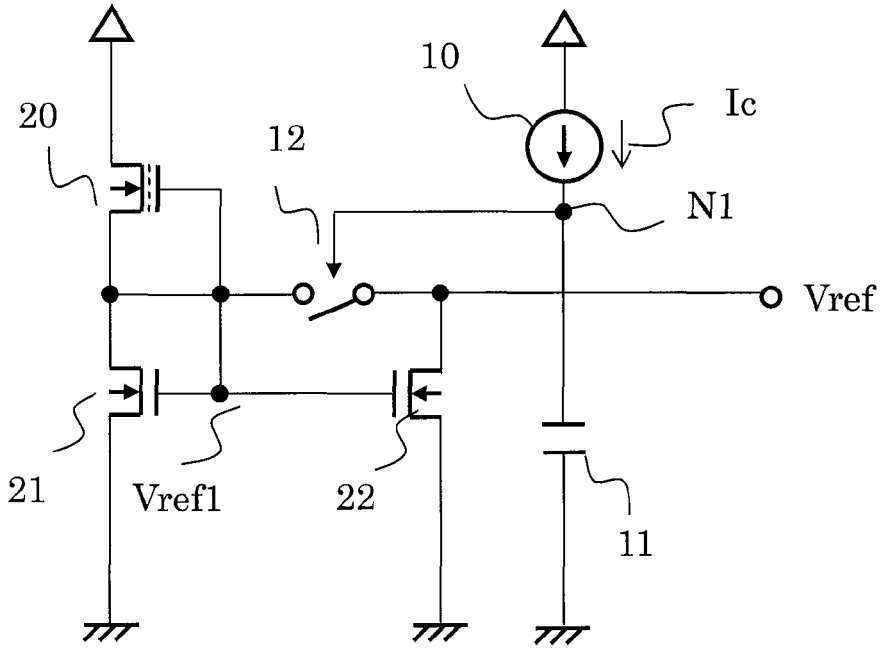
FIG. 1 is a circuit diagram of a reference voltage circuit having a soft start function according to a first embodiment of the present invention.
Figure 2:
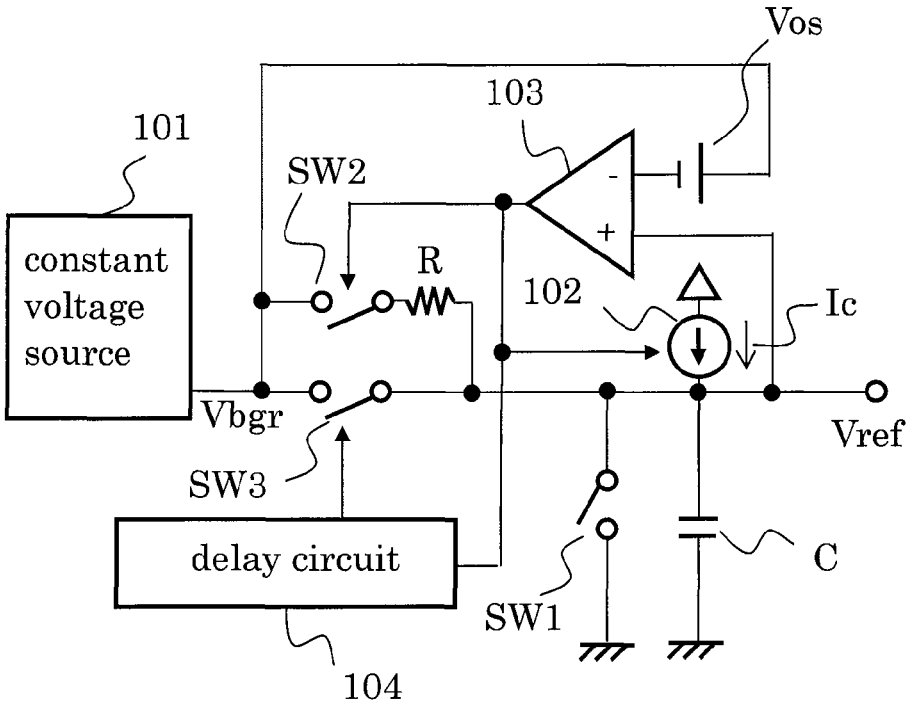
Fig. 2 Prior Art
FIG. 2 is a circuit diagram of a conventional reference voltage circuit having a soft start function.

FIG. 1 is a circuit diagram of a reference voltage circuit having a soft start function according to a first embodiment of the present invention.

The reference voltage circuit includes a reference voltage generation section and a soft start circuit. The reference voltage generation section includes a depletion mode MOS transistor 20 and a first enhancement mode MOS transistor 21. The soft start circuit includes a constant current source 10, a capacitor 11, a MOS switch 12, and a second enhancement mode MOS transistor 22.

The depletion mode MOS transistor 20 has a drain connected to a power supply, and a gate and a source connected to each other. The first enhancement mode MOS transistor 21 has a gate and a drain connected to each other, and a source connected to a ground. The gate and the source of the depletion mode MOS transistor 20 are connected to the gate and the drain of the first enhancement mode MOS transistor 21, and a connection point therebetween corresponds to an output terminal of the reference voltage generation section.

The second enhancement mode MOS transistor 22 has a gate connected to the gate and the drain of the first enhancement mode MOS transistor 21, a source connected to the ground, and a drain connected to an output terminal of a reference voltage Vref. The MOS switch 12 is connected to the output terminal of the reference voltage generation section and the drain of the second enhancement mode MOS transistor 22, and is turned ON/OFF under the control of a voltage at a node N1.

The capacitor 11 has one side connected to the constant current source 10 and another side connected to the ground. A connection point between the constant current source 10 and the capacitor 11 is used to provide a control signal for the MOS switch 12.

Next, an operation of the reference voltage circuit is described.

When a power supply voltage is applied to the reference voltage circuit, the reference voltage generation section and the soft start circuit therein operate as described below.

A current flows through the depletion mode MOS transistor 20 from the drain to the source. The current flowing through the depletion mode MOS transistor 20 flows to the drain of the first enhancement mode MOS transistor 21, and then to the ground. Based on the current flowing from the drain of the first enhancement mode MOS transistor 21 to the ground, a voltage Vref1 generated at the output terminal of the reference voltage generation section is determined.

The constant current source 10 allows a constant current Ic to flow to the capacitor 11 to start charging the capacitor 11. At this time, the voltage at the node N1 is equal to a ground voltage because the capacitor 11 is not sufficiently charged. Therefore, the MOS switch 12 is in an OFF state. Although the voltage Vref1 is applied to the gate of the second enhancement mode MOS transistor 22, the drain thereof is connected to the MOS switch 12 in the OFF state, and hence a drain current does not flow. Therefore, the output terminal of the reference voltage circuit outputs the reference voltage Vref of 0 V.

After that, the charging of the capacitor 11 with the constant current Ic is continued to increase the voltage at the node N1, which causes the MOS switch 12 to gradually turn ON. Therefore, the current flowing through the depletion mode MOS transistor 20 also starts to flow through the second enhancement mode MOS transistor 22. As the current flowing through the second enhancement mode MOS transistor 22 gradually increases, the reference voltage Vref gradually increases, which realizes the soft start operation.

After the capacitor 11 is sufficiently charged with the constant current Ic, the MOS switch 12 is completely turned ON. As a result, an on-resistance value of the MOS switch 12 becomes small enough to be negligible. Here, in a case where the first enhancement mode MOS transistor 21 and the second enhancement mode MOS transistor 22 are formed in the same size, the same current flows through the two enhancement mode MOS transistors when the MOS switch 12 is completely turned ON, and hence the voltage Vref1 substantially equals the reference voltage Vref. By setting the voltage obtained at the time when the same current flows through the first enhancement mode MOS transistor 21 and the second enhancement mode MOS transistor 22 as the reference voltage Vref in advance, the reference voltage may be increased from the soft start period to reach the reference voltage Vref while maintaining continuity.

Figure 3:
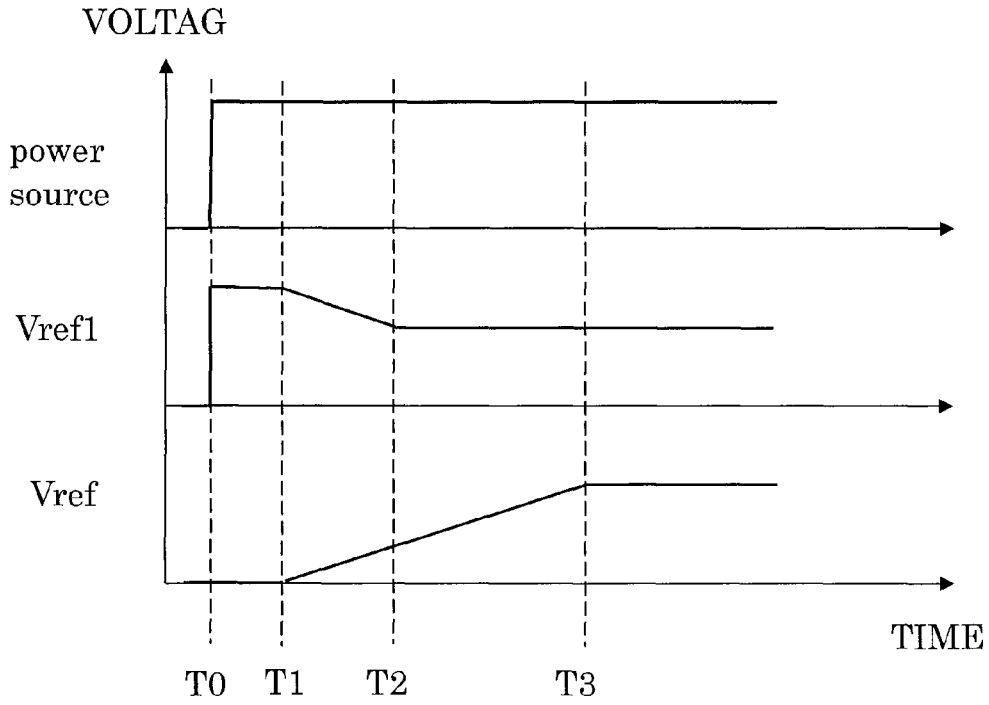
FIG. 3 is an operation explanatory diagram of the reference voltage circuit having the soft start function according to the first embodiment of the present invention.

Next, an operation is described with reference to an operation explanatory diagram illustrated in FIG. 3.

At a timing of time T0, the power supply voltage is applied. The voltage Vref1 is generated at the connection point between the depletion mode MOS transistor 20 and the first enhancement mode MOS transistor 21. The voltage Vref1 is not output to the output terminal of the reference voltage circuit because the voltage at the node N1 does not increase and the MOS switch 12 is in an OFF state until time T1. The reference voltage Vref is 0 V because the second enhancement mode MOS transistor 22 is turned ON.

The MOS switch 12 is gradually turned ON from a timing at time T1. Accordingly, a current starts to flow through the second enhancement mode MOS transistor 22, and hence the reference voltage Vref gradually increases. On the other hand, the current flowing through the first enhancement mode MOS transistor 21 decreases, and hence the voltage Vref1 decreases. At a timing of time T2, the same amount of current flows through the first enhancement mode MOS transistor 21 and the second enhancement mode MOS transistor 22. However, the voltage Vref1 is influenced by the on-resistance of the MOS switch 12, and hence takes a current value larger than that of the reference voltage Vref. Then, at a timing of time T3, the on-resistance of the MOS switch 12 becomes small enough to be negligible, and hence the voltage Vref1 and the reference voltage Vref become substantially equal to each other.

As described above, the voltage at the node N1 gradually increases to reduce the on-resistance of the MOS switch 12. As a result, the voltage Vref1 gradually decreases, and on the other hand, the reference voltage Vref gradually increases. Thus, the soft start operation with a continuous voltage is obtained.

Further, an initial value of the reference voltage Vref is 0 V owing to the action of the second enhancement mode MOS transistor 22, and hence a stable soft start operation may be performed.

Still further, by changing the settings of the capacitor 11 and the constant current source 10, the soft start period may be arbitrary set.

Figure 4:
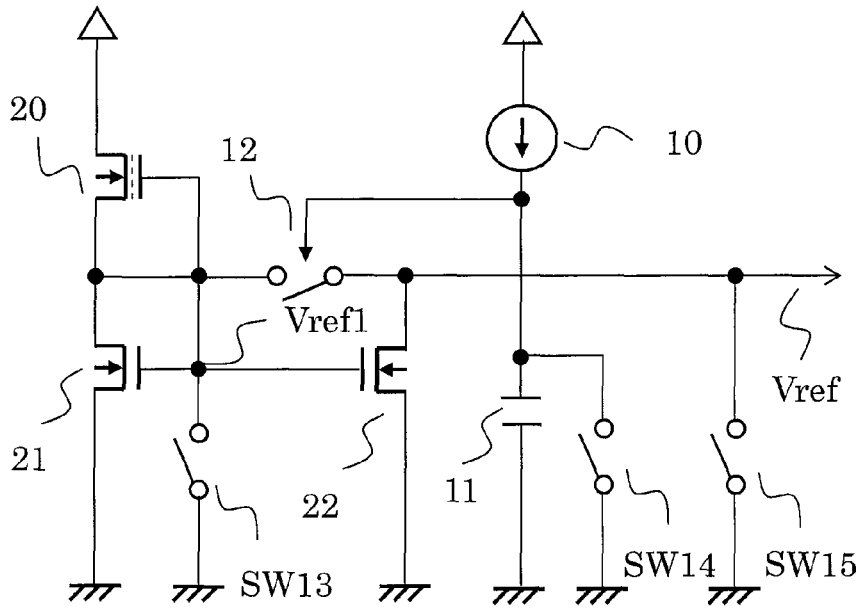
FIG. 4 is a circuit diagram of another example of the reference voltage circuit having the soft start function according to the first embodiment of the present invention.

Note that, an embodiment of the reference voltage circuit according to the present invention is described with reference to the circuit of FIG. 1. Alternatively, the soft start operation may be performed using an ON/OFF control signal as illustrated in a circuit of FIG. 4. In the circuit of FIG. 4, the ON/OFF control signal controls a switch SW13, a switch SW14, and a switch SW15. That is, when the ON/OFF control signal turns the switches OFF from ON, the soft start operation is performed, similarly to the circuit of FIG. 1.

(Second Embodiment)

Figure 5:
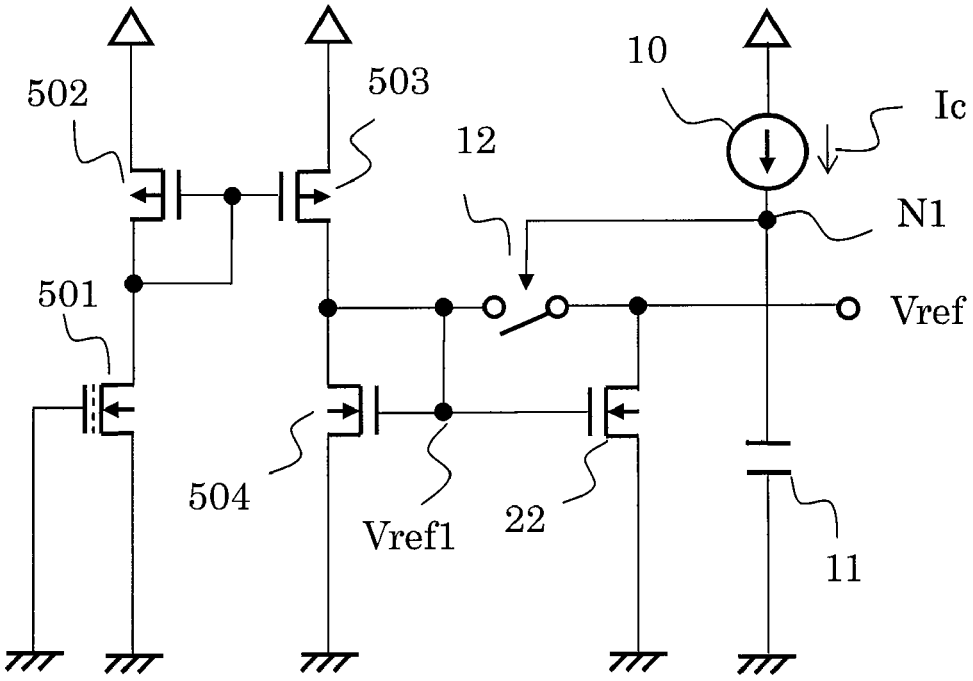
FIG. 5 is a circuit diagram of a reference voltage circuit having a soft start function according to a second embodiment of the present invention.

FIG. 5 is a circuit diagram of a reference voltage circuit having a soft start function according to a second embodiment of the present invention. FIG. 5 is different from FIG. 1 in that, in place of the depletion mode MOS transistor 20 and the enhancement mode MOS transistor 21, a depletion mode MOS transistor 501, enhancement mode PMOS transistors 502 and 503, and an enhancement mode MOS transistor 504 are provided.

The depletion mode MOS transistor 501 has a gate and a source, which are connected to the ground, and a drain connected to a drain and a gate of the enhancement mode PMOS transistor 502. The enhancement mode PMOS transistor 502 has a source connected to the power supply terminal. The enhancement mode PMOS transistor 503 has a gate connected to the gate of the enhancement mode PMOS transistor 502, a drain connected to a drain and a gate of the enhancement mode MOS transistor 504, and a source connected to the power supply terminal. The enhancement mode MOS transistor 504 has the gate and the drain connected to the MOS switch 12 and a gate of the enhancement mode MOS transistor 22, and a source connected to the ground.

Next, an operation of the reference voltage circuit according to the second embodiment is described. When a power supply voltage is applied, a current flows through the depletion mode MOS transistor 501, and a current flows through the enhancement mode MOS transistor 504 via a current mirror between the enhancement mode PMOS transistors 502 and 503. Then, because the current flows through the enhancement mode MOS transistor 504, the voltage Vref1 is generated between the gate and the source thereof, and the voltage Vref1 is input to the MOS switch 12 and the gate of the enhancement mode MOS transistor 22.

The constant current source 10 allows the constant current Ic to flow to the capacitor 11 to start charging the capacitor 11. At this time, the voltage at the node N1 is equal to the ground voltage because the capacitor 11 is not sufficiently charged. Therefore, the MOS switch 12 is in an OFF state. Although the voltage Vref1 is applied to the gate of the enhancement mode MOS transistor 22, the drain thereof is connected to the MOS switch 12 in the OFF state, and hence a drain current does not flow. Therefore, the output terminal of the reference voltage circuit outputs the reference voltage Vref of 0 V.

After that, the charging of the capacitor 11 with the constant current Ic is continued to increase the voltage at the node N1, which causes the MOS switch 12 to gradually turn ON. Therefore, the current flowing through the enhancement mode PMOS transistor 503 also starts to flow through the enhancement mode MOS transistor 22. As the current flowing through the enhancement mode MOS transistor 22 gradually increases, the reference voltage Vref gradually increases, which realizes the soft start operation.

After the capacitor 11 is sufficiently charged with the constant current Ic, the MOS switch 12 is completely turned ON. As a result, an on-resistance value of the MOS switch 12 becomes small enough to be negligible. Here, in a case where the enhancement mode MOS transistor 504 and the enhancement mode MOS transistor 22 are formed in the same size, the same current flows through the two enhancement mode MOS transistors when the MOS switch 12 is completely turned ON, and hence the voltage Vref1 substantially equals the reference voltage Vref. By setting the voltage obtained at the time when the same current flows through the enhancement mode MOS transistor 504 and the enhancement mode MOS transistor 22 as the reference voltage Vref in advance, the reference voltage may be increased from the soft start period to reach the reference voltage Vref while maintaining continuity.

As described above, the voltage at the node N1 gradually increases to reduce the on-resistance of the MOS switch 12. As a result, the voltage Vref1 gradually decreases, and on the other hand, the reference voltage Vref gradually increases. Thus, the soft start operation with a continuous voltage is obtained.

Further, an initial value of the reference voltage Vref is 0 V owing to the action of the enhancement mode MOS transistor 22, and hence a stable soft start operation may be performed.

Still further, by changing the settings of the capacitor 11 and the constant current source 10, the soft start period may be arbitrary set.

What is claimed is:

1. A reference voltage circuit, comprising:

a reference voltage section comprising a depletion mode MOS transistor and a first enhancement mode MOS transistor; and a soft start circuit, wherein the soft start circuit comprises:

a second enhancement mode MOS transistor having a gate connected to a gate and a drain of the first enhancement mode MOS transistor, and a drain connected to an output terminal of the reference voltage circuit;

a MOS switch having one terminal connected to an output terminal of the reference voltage section, and another terminal connected to the drain of the second enhancement mode MOS transistor; and a constant current source and a capacitor connected in series between a power supply and a ground, and wherein the MOS switch is gradually turned ON by a voltage supplied when the capacitor is charged with a current of the constant current source, to thereby gradually raise a reference voltage.

2. A reference voltage circuit, comprising:

a reference voltage section; and a soft start circuit, the reference voltage section comprising:

a depletion mode MOS transistor having a gate and a source, which are connected to a ground;

a first enhancement mode PMOS transistor having a source connected to a power supply terminal, and a gate and a drain connected to a drain of the depletion mode MOS transistor;

a second enhancement mode PMOS transistor having a gate connected to the gate of the first enhancement mode PMOS transistor, and a source connected to the power supply terminal; and a first enhancement mode NMOS transistor having a gate and a drain connected to a drain of the second enhancement mode PMOS transistor, wherein the soft start circuit comprises:

a second enhancement mode NMOS transistor having a gate connected to the gate and the drain of the first enhancement mode NMOS transistor, and a drain connected to an output terminal of the reference voltage circuit;

a MOS switch having one terminal connected to an output terminal of the reference voltage section, and another terminal connected to the drain of the second enhancement mode NMOS transistor; and a constant current source and a capacitor connected in series between a power supply and a ground, and wherein the MOS switch is gradually turned ON by a voltage supplied when the capacitor is charged with a current of the constant current source, to thereby gradually raise a reference voltage.

3. A reference voltage circuit according to claim 1, further comprising a first start-up switch connected to a connection node between the constant current source and the capacitor.

4. A reference voltage circuit according to claim 2, further comprising a first start-up switch connected to a connection node between the constant current source and the capacitor.

5. A reference voltage circuit according to claim 3, further comprising a second start-up switch connected to the output terminal of the reference voltage circuit.

6. A reference voltage circuit according to claim 4, further comprising a second start-up switch connected to the output terminal of the reference voltage circuit.

* * * * *